US006514054B1

(12) United States Patent
Liu

(10) Patent No.: US 6,514,054 B1
(45) Date of Patent: Feb. 4, 2003

(54) CEILING FAN HOUSING ASSEMBLY

(75) Inventor: Ching-Wen Liu, Feng Yuan (TW)

(73) Assignee: Pan Air Electric Co., Ltd., Feng Yuan (TW)

( * ) Notice: Subject to any disclaimer, the term of this patent is extended or adjusted under 35 U.S.C. 154(b) by 0 days.

(21) Appl. No.: 09/949,356

(22) Filed: Sep. 7, 2001

(51) Int. Cl.[7] ..... F04B 17/00

(52) U.S. Cl. ..... 417/423.7; 417/423.14; 417/423.15; 416/5; 416/244 R

(58) Field of Search ..... 417/423.14, 423.15, 417/423.1, 424.1; 416/5, 244 R, 246, 170 R

(56) References Cited

U.S. PATENT DOCUMENTS 5,222,864 A * 6/1993 Pearce ..... 416/5
6,015,274 A * 1/2000 Bias et al. ..... 417/423.1

* cited by examiner

*Primary Examiner*—Charles G. Freay
*Assistant Examiner*—John F Belena
(74) *Attorney, Agent, or Firm*—Alan D. Kamrath; Rider, Bennett, Egan & Arundel

(57) ABSTRACT

A ceiling fan housing assembly includes an upper casing mounted on the top of a motor, a fastener mounted on the bottom of the motor and a lower casing attached to the fastener. The fastener includes an annular flange laterally extending from the fastener and multiple equally spaced threaded holes defined in the annular flange. A bracket extends from the flange and a reversing switch is mounted on a free end of the bracket. The reversing switch has a switch bar that extends through the housing assembly. The lower casing abuts the upper casing to form a chamber to hold the motor. The lower casing includes multiple equally spaced through holes defined in the bottom of the lower casing, and a slot is defined in of the lower casing to allow the switch bar of the reversing switch to extend through the lower casing.

3 Claims, 4 Drawing Sheets

CEILING FAN HOUSING ASSEMBLY

BACKGROUND OF THE INVENTION

1. Field of the Invention

The present invention relates to a housing assembly, and more particularly to a ceiling fan housing assembly.

2. Description of Related Art

With reference to FIGS. 3 and 4, a conventional ceiling fan housing assembly in accordance with the prior art comprises a fastener (50), an upper cover (60) and a lower casing (70). The fastener (50) is adapted to be attached to a ceiling fan motor (not shown). The upper cover (60) is attached to the top of the motor. The lower casing (70) is attached to the fastener (50). The fastener (50) comprises an annular flange (51) laterally extending from an outer periphery of the fastener (50) and multiple threaded holes (511) defined in the flange (51) of the fastener (50). The upper cover (60) and the lower casing (70) are bowl-shaped and abut each other to form a chamber to receive a motor (not shown). The lower casing (70) has a bottom having multiple through holes (71) each defined to align with one of the threaded holes (511) in the fastener (50). A reversing switch (80) is mounted on an inner periphery of the lower casing (70) and has a switch bar (81) extending through the lower casing (70) for user to control the rotating direction of the motor.

To assemble the conventional housing assembly of a ceiling fan, the upper casing (60) and the fastener (50) are respectively secured to the motor. Two screws (800) are screwed through the lower casing (70) from an outer periphery to the inner periphery of the lower casing (70) to hold the reversing switch (80) in place on the inner periphery of the lower casing (70). The lower casing (70) is attached to the fastener (50) by bolts (700) extending through the bottom of the lower casing (70) and screwed into the threaded holes (511) in the fastener (50).

The method of assembling the convention housing assembly of a ceiling fan has several disadvantages.

1. The threaded hole (511) in the fastener (50) and the through hole (71) in the lower casing (70) are defined prior to the assembly. Consequently, the user must rotate the lower casing (70) to align the through holes (71) with the threaded holes (511) because there is no alignment fixture between the upper casing (60) and the lower casing (70). A lot of time will be required to assembly the ceiling fan because it is assembled on the ceiling.

2. To reduce manufacturing cost, the lower casing (70) and the upper casing (60) are usually made of sheet metal by a press so the edges are very sharp. The sharp edge may injure the user's finger when the lower casing (70) is rotated to align the through holes (71) in the lower casing (70) with the threaded hole (511) in the fastener (50).

The present invention has arisen to mitigate and/or obviate the disadvantages of the conventional housing assembly of a ceiling fan.

SUMMARY OF THE INVENTION

The main objective of the present invention is to provide an improved housing assembly of a ceiling fan, which is easy to assemble.

To achieve the objective, the housing assembly of the ceiling fan in accordance with the present invention includes an upper casing mounted on the top of a motor and a fastener mounted on the bottom of the motor. The fastener includes an annular flange laterally extending from the fastener with multiple threaded holes defined in the annular flange. A bracket extends from the flange, and a reversing switch is mounted on a free end of the bracket. The reversing switch has a switch bar extending through the housing assembly. A lower casing is attached to the fastener and abuts the upper casing to form a chamber to hold the motor. The lower casing includes multiple through holes defined in the bottom of the lower casing, and a slot is defined in the lower casing to allow the switch bar of the reversing switch to extend through the lower casing.

Consequently, the through holes in the lower casing align with corresponding threaded holes in the fastener when the switch bar on the reversing switch extends through the slot in the lower casing. The reversing switch acts as an alignment device for the holes and will save time during assembly of the housing assembly of the ceiling fan.

Further benefits and advantages of the present invention will become apparent after a careful reading of the detailed description with appropriate reference to the accompanying drawings.

DETAILED DESCRIPTION OF THE INVENTION

Figure 1:
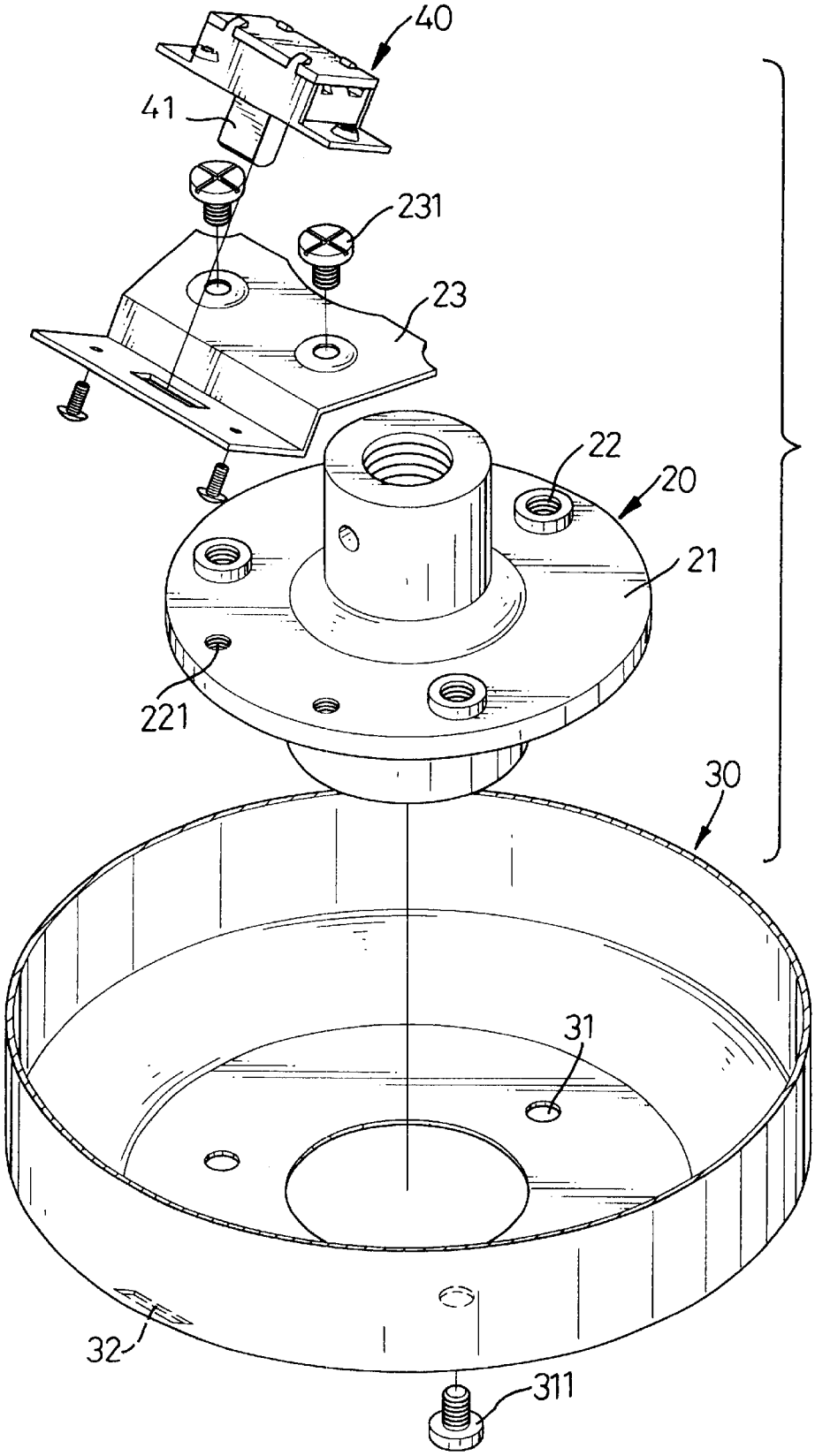
FIG. 1 is a partially exploded perspective view of a housing assembly of a ceiling fan in accordance with the present invention.
Figure 2:
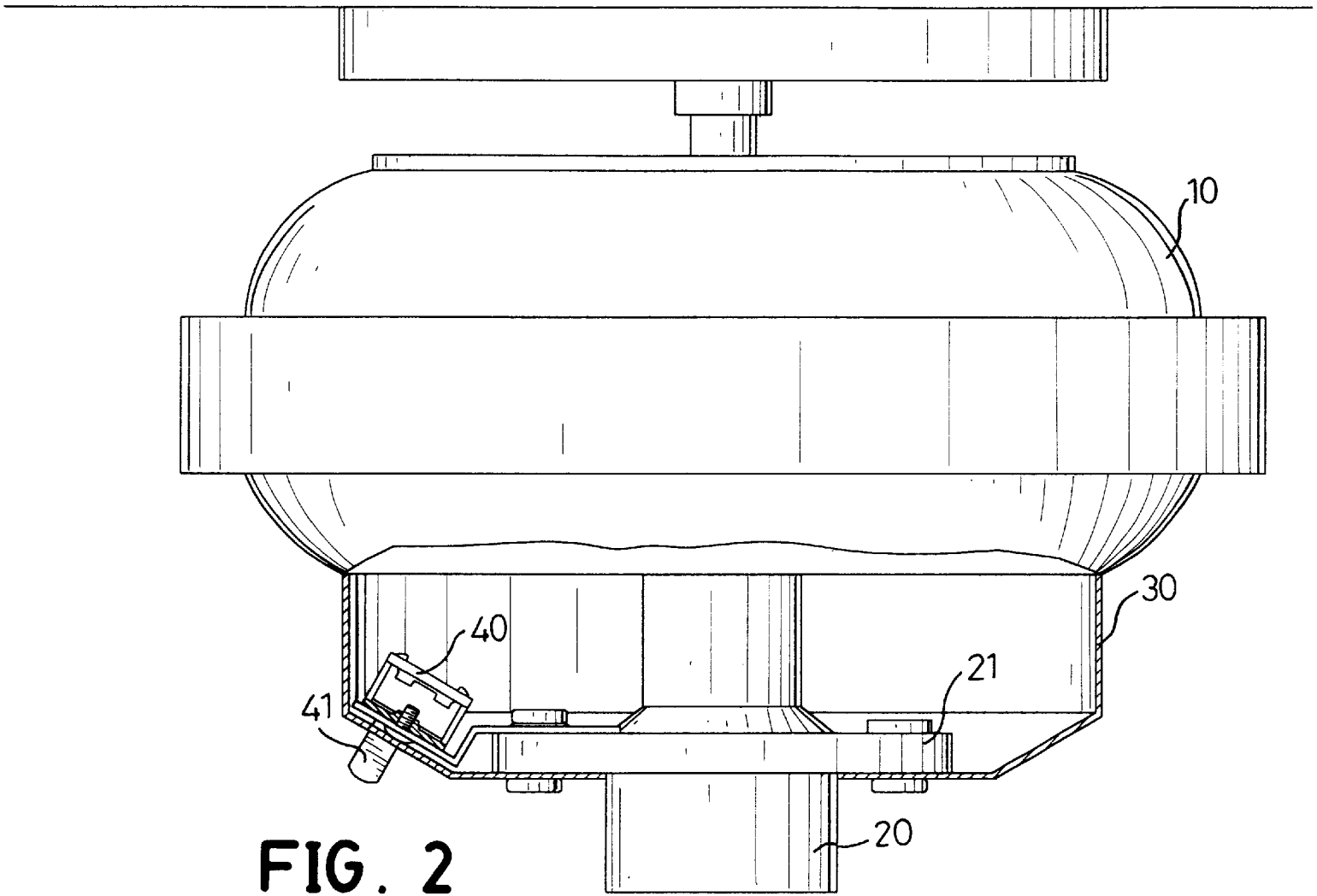
FIG. 2 is a side plan view in partial section of the housing assembly of the ceiling fan in FIG. 1.
Figure 3:
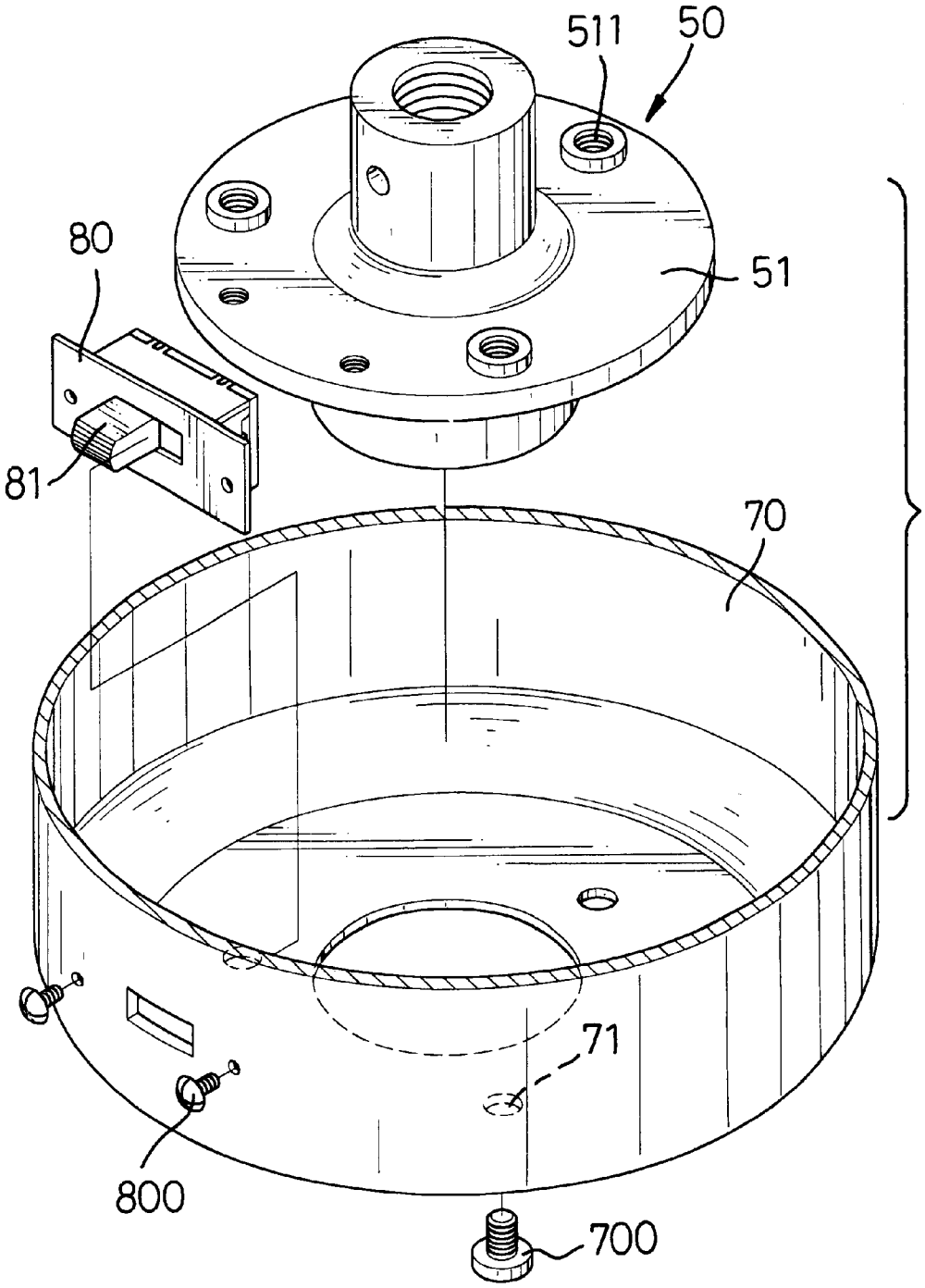
FIG. 3 PRIOR ART
FIG. 3 is a partially exploded perspective view of a conventional housing assembly of a ceiling fan in accordance with the prior art.
Figure 4:
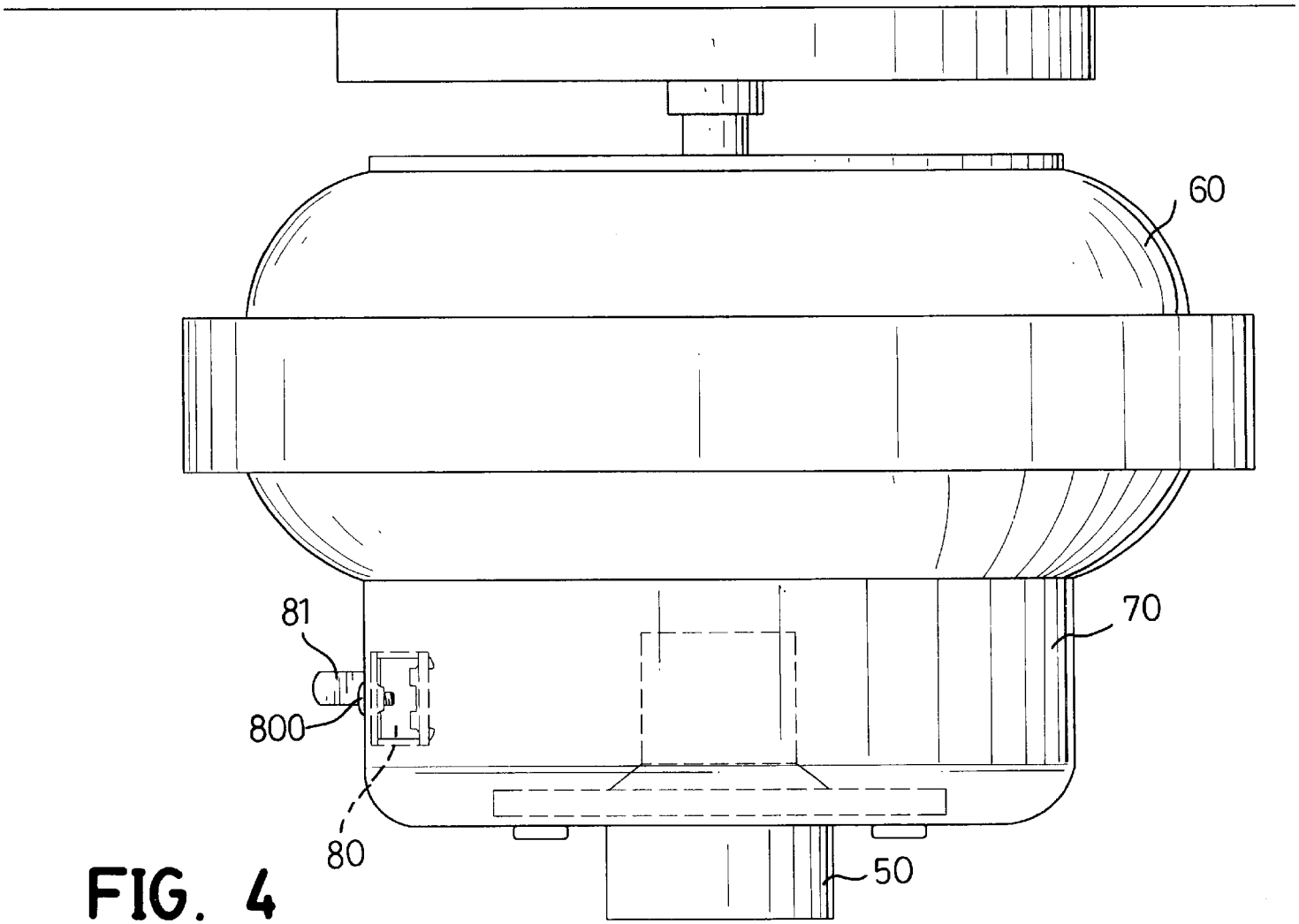
FIG. 4 PRIOR ART
FIG. 4 is a side plan view in partial section of the conventional housing assembly of a ceiling fan in FIG. 3.

With reference to the drawings and initially to FIGS. 1 and 2, a ceiling fan housing assembly in accordance with the present invention comprises an upper casing (10), a fastener (20) and a lower casing (30). The upper casing (10) is adapted to be mounted on the top of the motor of the ceiling fan. The fastener (20) is adapted to be mounted on the bottom of the motor. The lower casing (30) is attached to the fastener (20). The upper casing (10) and the lower casing (30) are bowl-shaped and abut each other to form a chamber (not shown) to hold the motor. The lower casing (30) has a completely open top and a partially closed bottom.

The fastener (20) comprises a vertical body (not numbered) and an annular flange (21) laterally extending from an outer periphery of the body of the fastener (20). Multiple equally spaced first threaded holes (22) are defined in the flange (21). Two second threaded holes (221) are defined in the flange (21) of the fastener (20) between two of the first threaded holes (22). A bracket (23) extends from the flange (21) and a reversing switch (40) is mounted on a free end of the bracket (23). The bracket (23) is mounted on the flange (21) by using two bolts (231) extending through the bracket (23) and screwed into the second threaded holes (221) in the flange (21) or integrally extends from the flange (21). For reducing manufacturing cost, the bracket (23) in the preferred embodiment of present invention is mounted on the flange (21) by bolts (231). A reversing switch (40) is mounted on the bracket (23) and has a switch bar (41) that extends through the lower casing (30) for a user to control the direction of rotation of the ceiling fan. The lower casing (30) includes a bottom having multiple equally spaced through holes (31) aligning with and corresponding to the first threaded holes (22) in the flange (21). A bolt (311) extends through each through hole (31) in the bottom of the lower casing (30) and is screwed into the corresponding first threaded hole (22) to hold the lower casing (30) in place. A slot (32) is defined in the lower casing (30) and corresponds to the two second threaded holes (221) in the flange (21) to allow the switch bar (41) to extend through the lower casing (30).

The housing assembly of a ceiling fan in accordance with the present invention has several advantages.

1. The bracket (23) is mounted on the flange (21) and the reversing switch (40) is mounted on the bracket (23) prior to any other assembly. The reversing switch (23) is used as an alignment device when attaching the lower casing (30) to the fastener (20). Specifically, the second threaded holes (221) and the first threaded holes (22) in the fastener (20) and the slot (32) and the through holes (31) in the lower casing (31) are positioned so that the through holes (31) in the lower casing (30) align with the threaded holes (22) in the fastener (20) when the switch bar (41) extends through the slot (32) in the lower casing (30). Consequently, users do not need to rotate the lower casing (30) when attaching the lower casing (30) to the fastener (20). Using the slot (32) and the reversing switch (40) switch bar (41) as an alignment device will save manufacturing time.

2. The edges of the upper casing (10) and the lower casing (30) will never injure a user's finger even if they are sharp because rotating the lower casing (30) is not necessary.

Although the invention has been explained in relation to its preferred embodiment, it is to be understood that many other possible modifications and variations can be made without departing from the spirit and scope of the invention as hereinafter claimed.

What is claimed is:

1. A ceiling fan housing assembly comprising:

an upper casing adapted to be mounted on a top of a motor;

a fastener adapted to be mounted on a bottom of the motor and including:

a vertically oriented body;

an annular flange laterally extending from an outer periphery of the body of the fastener; and multiple equally spaced first threaded holes defined in the annular flange of the fastener;

a bracket extending from the flange of the fastener;

a reversing switch mounted on a free end of the bracket, the reversing switch having a switch bar extending through the housing assembly; and a bowl-shaped lower casing attached to the fastener and abutting the upper casing to form a chamber adapted to hold the motor of the ceiling fan, the lower casing including:

multiple equally spaced through holes defined in a bottom of the lower casing; and a slot defined in a periphery of the lower casing to allow the switch bar of the reversing switch to extend through the lower casing;

wherein the through holes in the lower casing align with the first threaded holes in the fastener when the switch bar of the reversing switch extends through the slot in the lower casing and the combination of the slot and the switch bar act as an alignment device for the first threaded holes in the fastener and the through holes in the lower casing to save time in assembly of the ceiling fan housing assembly.

2. The ceiling fan housing assembly as claimed in claim 1, wherein the bracket is integrally formed with the flange of the fastener.

3. The housing assembly of a ceiling fan as claimed in claim 1, wherein the fastener comprises a pair of second threaded holes defined in the flange and between adjacent first threaded holes, and the bracket is attached to the flange by bolts screwed into the second threaded holes.

* * * * *